US007588504B2

(12) United States Patent
Matsunaga

(10) Patent No.: US 7,588,504 B2
(45) **Date of Patent: *Sep. 15, 2009**

(54) HOLLOW GOLF CLUB HEAD

(75) Inventor: Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 232 days.

This patent is subject to a terminal disclaimer.

(21) Appl. No.: 11/322,075

(22) Filed: Dec. 30, 2005

(65) Prior Publication Data

US 2007/0049399 A1 Mar. 1, 2007

(30) Foreign Application Priority Data

Aug. 23, 2005 (JP) ..... 2005-241748

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS

| | | | |
|---|---|---|---|
| 4,139,196 | A | 2/1979 | Riley |
| 5,180,166 | A | 1/1993 | Schmidt et al. |
| 5,205,560 | A | 4/1993 | Hoshi et al. |
| 5,255,913 | A | 10/1993 | Tsuchida |
| 5,346,217 | A | 9/1994 | Tsuchiya et al. |
| 5,351,958 | A | 10/1994 | Helmstetter |
| 5,411,255 | A | 5/1995 | Kurashima et al. |
| 5,511,786 | A | 4/1996 | Antonious |
| 5,573,467 | A | 11/1996 | Chou et al. |
| 5,755,627 | A | 5/1998 | Yamazaki et al. |
| 5,916,038 | A | 6/1999 | Uchiyama et al. |
| 5,954,594 | A | 9/1999 | Uchiyama et al. |

(Continued)

FOREIGN PATENT DOCUMENTS

GB 2 249 031 A 4/1992

(Continued)

OTHER PUBLICATIONS

Jackson, Jeff. The Modern Guide to Golf Clubmaking. Ohio: Dynacraft Golf Products Inc., copyright 1994, p. 237.*

(Continued)

*Primary Examiner*—Alvin A Hunter
(74) *Attorney, Agent, or Firm*—Sughrue Mion, PLLC

(57) ABSTRACT

This invention provides a hollow golf club head in which the ratio of the rigidity of a sole portion to that of a crown portion is 1:0.1 to 0.8. This invention also provides a hollow golf club head in which a crown low-rigidity region is formed on the face side of the crown portion, and a crown high-rigidity region is formed on the back side of the crown portion. The ratio of the rigidity of the crown high-rigidity region to that of the crown low-rigidity region is 1:0.2 to 0.6. Furthermore, this invention provides a hollow golf club head in which a sole high-rigidity region is formed on the face side of the sole portion, and a sole low-rigidity region is formed on the back side of the sole portion. The ratio of the rigidity of the sole high-rigidity region to that of the sole low-rigidity region is 1:0.2 to 0.5.

23 Claims, 18 Drawing Sheets

U.S. PATENT DOCUMENTS

| | | | | |
|---|---|---|---|---|
| 6,162,133 | A | 12/2000 | Peterson | |
| 6,348,013 | B1 | 2/2002 | Kosmatka | |
| 6,494,790 | B1 | 12/2002 | Toyota et al. | |
| 6,572,491 | B2 * | 6/2003 | Hasebe et al. | 473/349 |
| 6,719,645 | B2 * | 4/2004 | Kouno | 473/345 |
| 6,783,465 | B2 | 8/2004 | Matsunaga | |
| 6,783,466 | B2 | 8/2004 | Seki et al. | |
| 6,830,519 | B2 | 12/2004 | Reed et al. | |
| 6,945,876 | B2 | 9/2005 | Nakahara et al. | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0236133 | A1 * | 12/2003 | Shimazaki et al. | 473/345 |
| 2004/0078955 | A1 | 4/2004 | Matsunaga | |
| 2004/0204264 | A1 | 10/2004 | Matsunaga et al. | |
| 2005/0003904 | A1 | 1/2005 | Imamoto et al. | |
| 2005/0023329 | A1 | 2/2005 | Song | |
| 2005/0124436 | A1 | 6/2005 | Kakiuchi et al. | |
| 2006/0063608 | A1 * | 3/2006 | Mori et al. | 473/345 |

FOREIGN PATENT DOCUMENTS

| | | | |
|---|---|---|---|
| JP | 07-155410 | A | 6/1995 |
| JP | 7-284546 | A | 10/1995 |
| JP | 10263120 | A | 10/1998 |
| JP | 11-057085 | A | 3/1999 |
| JP | 2000-317018 | A | 11/2000 |
| JP | 2001-346918 | A | 12/2001 |
| JP | 2002315855 | A | 10/2002 |
| JP | 2003-52866 | A | 2/2003 |
| JP | 2003-79768 | A | 3/2003 |
| JP | 2003-88601 | A | 3/2003 |
| JP | 2004-65660 | A | 3/2004 |
| JP | 2004-167127 | A | 6/2004 |
| JP | 2004-180759 | A | 7/2004 |
| JP | 2004-222792 | A | 8/2004 |
| JP | 2004-229820 | A | 8/2004 |
| JP | 2005-006698 | A | 1/2005 |
| JP | 2005-130935 | A | 5/2005 |
| JP | 2005-137788 | A | 6/2005 |
| WO | WO 99/22824 | A1 | 5/1999 |

OTHER PUBLICATIONS

Chinese Office Action Mailed Apr. 3, 2009.

* cited by examiner

HOLLOW GOLF CLUB HEAD

FIELD OF THE INVENTION

The present invention relates to a hollow golf club head in which the launch angle of a ball is increased so that the traveling distance of a shot can be increased.

BACKGROUND OF THE INVENTION

In recent years, hollow golf club heads have been proposed in which not only their face portion but also their crown portion deform elastically when hitting a ball, to increase the launch angle, so as to increase the traveling distance of a shot.

Japanese Patent Laid-Open No. 2003-52866 discloses a hollow golf club head made of metal and having a face portion, sole portion, side portion, crown portion, and hosel portion. This golf club head is formed of a front part and back part. The front part is made of a cast product in which at least the main portion of the crown portion and the face portion are integrally formed. In the back part, portions other than the front part are integrally formed. The front and back parts are joined to each other.

Japanese Patent Laid-Open No. 2003-79768 discloses a hollow golf club head made of metal and having at least a face portion, sole portion, side portion, and crown portion. A metal material that forms the crown portion has the lowest modulus of longitudinal elasticity.

Japanese Patent Laid-Open No. 2003-88601 discloses a hollow golf club head made of metal and having a face portion, sole portion, toe-side side portion, heel-side side portion, back-side side portion, crown portion, and hosel portion. The crown portion has a plurality of grooves extending from the toe-side side portion to the heel-side side portion.

Japanese Patent Laid-Open No. 2005-137788 discloses a hollow golf club head having a face portion with a face surface to hit the ball, and a head main body portion continuous to the rear surface-of the face portion and extending to the back of the head. The head main body portion includes a crown portion, sole portion, and side portion which respectively form a head upper portion, head bottom portion, and head side portion. The crown portion includes a crown front portion and crown rear portion. The crown front portion forms a front region extending from the rear surface of the face portion to a position at a distance 0.15 times a crown depth length Lc. The crown rear portion forms a rear region extending from the rear surface of the face portion to a position at a distance 0.30 times to 1.0 time the crown depth length Lc. The crown front portion has a rigidity lower than that of the crown rear portion.

The conventional golf club heads described above still have room for improvement in terms of increasing the launch angle of a ball.

SUMMARY OF THE INVENTION

The present invention has been made in order to overcome the deficits of prior art.

According to the aspects of the present invention, the following hollow golf club heads (1) to (3) are provided.

(1) A hollow golf club head having a sole portion and a crown portion, wherein a ratio of a rigidity of the sole portion to that of the crown portion is 1:0.1 to 0.8, a crown low-rigidity region is formed on the face side of the crown portion, a crown high-rigidity region is formed on the back side of the crown portion, and a ratio of a rigidity of the crown high-rigidity region to that of the crown low-rigidity region is 1:0.2 to 0.6.

(2) A hollow golf club head having a sole portion and a crown portion, wherein a ratio of a rigidity of the sole portion to that of the crown portion is 1:0.1 to 0.8, a sole high-rigidity region is formed on a face side of the sole portion, a sole low-rigidity region is formed on a back side of the sole portion, and a ratio of a rigidity of the sole high-rigidity region to that of the sole low-rigidity region is 1:0.2 to 0.5.

(3) A hollow golf club head having a sole portion and a crown portion, wherein a ratio of a rigidity of the sole portion to that of the crown portion is 1:0.1 to 0.8, a crown low-rigidity region is formed on a face side of the crown portion, a crown high-rigidity region is formed on a back side of the crown portion, a ratio of a rigidity of the crown high-rigidity region to that of the crown low-rigidity region is 1:0.2 to 0.6, a sole high-rigidity region is formed on a face side of the sole portion, a sole low-rigidity region is formed on a back side of the sole portion, and a ratio of a rigidity of the sole high-rigidity region to that of the sole low-rigidity region is 1:0.2 to 0.5.

The hollow golf club head according to the aspects of the invention can increase the launch angle of a ball so that the traveling distance of a shot can be further increased.

According to the aspects of the present invention, the rigidity refers to a value calculated by the following equation (x):

$$\text{rigidity (unit: MPa·mm}^4\text{)} = E \times I \quad (x)$$

where

E: Young's modulus (unit: MPa)

I: moment of inertia of area (unit: $mm^4$)

Young's modulus E depends on the material constituting the golf club head, and the moment I of inertia of area depends on the thickness of the constituent of the golf club head. If the thickness is the same, the ratio of rigidity is determined by the ratio of magnitudes of Young's modulus E. If the material is the same, the ratio of rigidity is determined by the value of the cube of the ratio of the thicknesses.

According to the aspects of the present invention, the sole portion of the golf club head refers to a portion extending backward from the lower portion of a face portion of the golf club head to form the bottom portion of the head. The crown portion of the golf club head refers to a portion extending backward from the upper portion of the face portion to form the upper portion of the head. A side portion of the golf club head refers to a portion extending backward from between the upper and lower portions of the face portion to form a head side portion. The side portion includes a toe-side side portion, heel-side side portion, and back-side side portion.

In the above hollow golf club heads (1) to (3) according to the aspects of the present invention, a preferable value of the ratio of the rigidity of the sole portion to that of the crown portion is 1:0.2 to 0.6.

In the above hollow golf club heads (1) and (3) according to the aspects of the present invention, a preferable value of the ratio of the rigidity of the crown high-rigidity region to that of the crown low-rigidity region is 1:0.3 to 0.5.

In the above hollow golf club heads (2) and (3) according to the aspects of the present invention, a preferable value of the ratio of the rigidity of the sole high-rigidity region to that of the sole low-rigidity region is 1:0.3 to 0.5.

In the above hollow golf club head (3) of the aspects of the present invention, a value (b/a) obtained such that a value (b) of the rigidity of the sole high-rigidity region is divided by a value (a) of the rigidity of the crown low-rigidity region is preferably larger than a value (B/A) obtained such that a value (B) of the rigidity of the sole portion is divided by a value (A) of the rigidity of the crown portion (i.e., b/a>B/A). With this arrangement, the launch angle of a ball can be increased more effectively.

According to the aspects of the present invention, in order to increase the launch angle of a ball, preferably, the ratio of the average thickness of the sole portion to that of the crown portion can be set to 1:0.3 to 0.8.A more preferable value of the ratio of the average thickness of the sole portion to that of the crown portion is 1:0.5 to 0.7.

According to the aspects of the present invention, in order to increase the launch angle of a ball, preferably, a crown thin-walled region as the crown low-rigidity region is formed on the face side of the crown portion, and a crown thick-walled region as the crown high-rigidity region is formed on the back side of the crown portion. The ratio of the average thickness of the crown thick-walled region to that of the crown thin-walled region can be set to 1:0.5 to 0.9. A more preferable value of the ratio of the average thickness of the crown thick-walled region to that of the crown thin-walled region is 1:0.5 to 0.7.

According to the aspects of the present invention, in order to increase the launch angle of a ball, preferably, a sole thick-walled region as the sole high-rigidity region is formed on the face side of the sole portion, and a sole thin-walled region as the sole low-rigidity region is formed on the back side of the sole portion. The ratio of the average thickness of the sole thick-walled region to that of the sole thin-walled region can be set to 1:0.3 to 0.8. A more preferable value of the ratio of the average thickness of the sole thick-walled region to that of the sole thin-walled region is 1:0.5 to 0.7.

According to the aspects of the present invention, in order to increase the launch angle of a ball, preferably, the ratio of the average thickness of the sole portion to that of the side portion can be set to 1:0.3 to 0.8.A more preferable value of the ratio of the average thickness of the sole portion to that of the side portion is 1:0.5 to 0.7.

According to the aspects of the present invention, in order to increase the launch angle of a ball, preferably, the average thickness of the sole portion is 0.9 mm to 2.0 mm, the average thickness of the crown portion is 0.5 mm to 1.2 mm, the average thickness of the crown low-rigidity region is 0.3 mm to 0.7 mm, the average thickness of crown high-rigidity region is 1.0 mm to 2.0 mm, the average thickness of the sole high-rigidity region is 1.5 mm to 3.0 mm, the average thickness of the sole low-rigidity region is 0.7 mm to 1.2 mm, and the average thickness of the side portion is 0.5 mm to 1.2 mm.

According to the aspects of the present invention, in order to increase the launch angle of a ball, preferably, the ratio of the rigidity of the sole portion to that of the side portion is desirably 1:0.1 to 0.8. A more preferable vale of the ratio of the rigidity of the sole portion to that of the side portion is 1:0.2 to 0.6.

The manufacturing method for the golf club head according to the aspects of the present invention is not particularly limited. For example, the golf club head can be manufactured by closing a face opening of a head main body with a face member. In this case, the material and molding method for the head main body are not particularly limited. Titanium, a titanium alloy, stainless steel, an amorphous material, or the like can be used as the material. The head main body can be monolithically molded by casting. The material and molding method for the face member are also not particularly limited. As with the material, titanium, a titanium alloy, stainless steel, an amorphous material, or the like can be used. As the molding method, forging, press forming of pressing a plate material, or die casting is preferable.

The method for joining the face member to the head main body is not particularly limited, but plasma welding, laser welding, or electron beam welding is suitable in terms of finishing the joined portion with a good appearance and improving the weight accuracy of the golf club head. In this case, plasma welding can be employed in which a welding target material is dissolved by a high-temperature energy generated by plasma arc and solidified again to weld. As for laser welding, known laser welding which uses a gas laser such as CO laser or $CO_2$ laser, or a solid laser such as a YAG laser can be employed. As for electron beam welding, known electron beam welding which uses an electron beam having an appropriate output can be employed.

The golf club head according to the aspects of the present invention can be formed as, e.g., a wood type golf club head or utility type golf club head having a hollow portion. More specifically, the golf club head according to the aspects of the present invention can be formed as a hollow golf club head having the following head volume and loft angle:

(a) a hollow golf club head having a head volume of 250 $cm^3$ to 470 $cm^3$ and a loft angle in a range from 7 to 15 degrees, (b) a hollow golf club head having a head volume of 150 $cm^3$ to 250 $cm^3$ and a loft angle in a range from 12 to 28 degrees, and (c) a hollow golf club head having a head volume of 70 $cm^3$ to 150 $cm^3$ and a loft angle in a range from 15 to 32 degrees.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
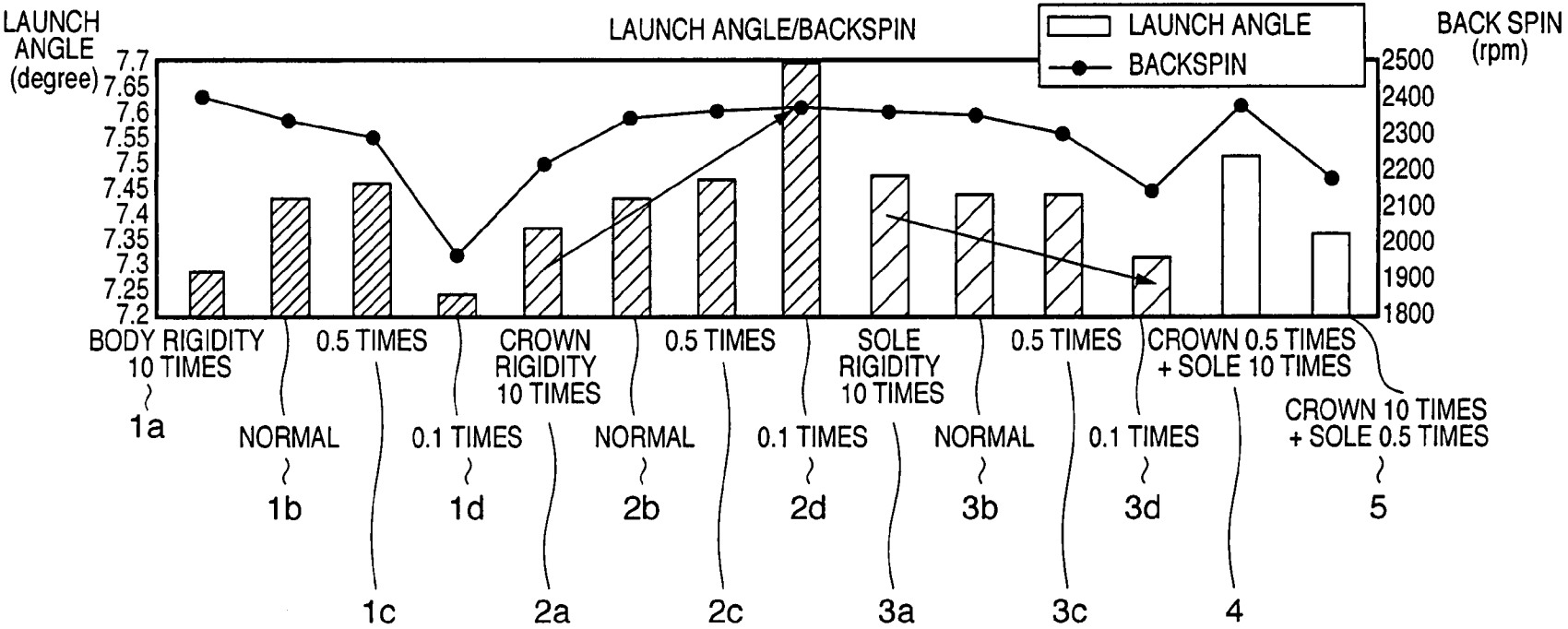
FIG. 1 is a graph showing variations of the launch angle of a ball and the backspin amount when body rigidity, crown rigidity, and sole rigidity of a golf club head are changed.

First, an experiment that demonstrates the effect of the present invention will be described. FIG. 1 is a graph showing variations of the launch angle of a ball angle and the backspin amount when the rigidity of the entire golf club head (body rigidity), the rigidity of the crown portion (crown rigidity), and the rigidity of the sole portion (sole rigidity) are changed. Referring to FIG. 1, sample number 1*a* indicates a golf club head with body rigidity 10 times the normal value. Sample number 1*b* indicates a golf club head with normal body rigidity (1 time). Sample number 1*c* indicates a golf club head with body rigidity 0.5 times the normal value. Sample number 1*d* indicates a golf club head with body rigidity 0.1 times the normal value. Sample number 2*a* indicates a golf club head with crown rigidity 10 times the normal value. Sample number 2*b* indicates a golf club head with normal crown rigidity (1 time). Sample number 2*c* indicates a golf club head with crown rigidity 0.5 times the normal value. Sample number 2*d* indicates a golf club head with crown rigidity 0.1 times the normal value. Sample number 3*a* indicates a golf club head with sole rigidity 10 times the normal value. Sample number 3*b* indicates a golf club head with normal sole rigidity (1 time). Sample number 3*c* indicates a golf club head with sole rigidity 0.5 times the normal value. Sample number 3*d* indicates a golf club head with sole rigidity 0.1 times the normal value. Sample number 4 indicates a golf club head with crown rigidity 0.5 times the normal value and sole rigidity 10 times the normal value. Sample number 5 indicates a golf club head with crown rigidity 10 times the normal value and sole rigidity 0.5 times the normal value. The results of FIG. 1 show that when the rigidity of the crown portion is decreased and that of the sole portion is increased, the launch angle of a ball increases.

Figure 2:
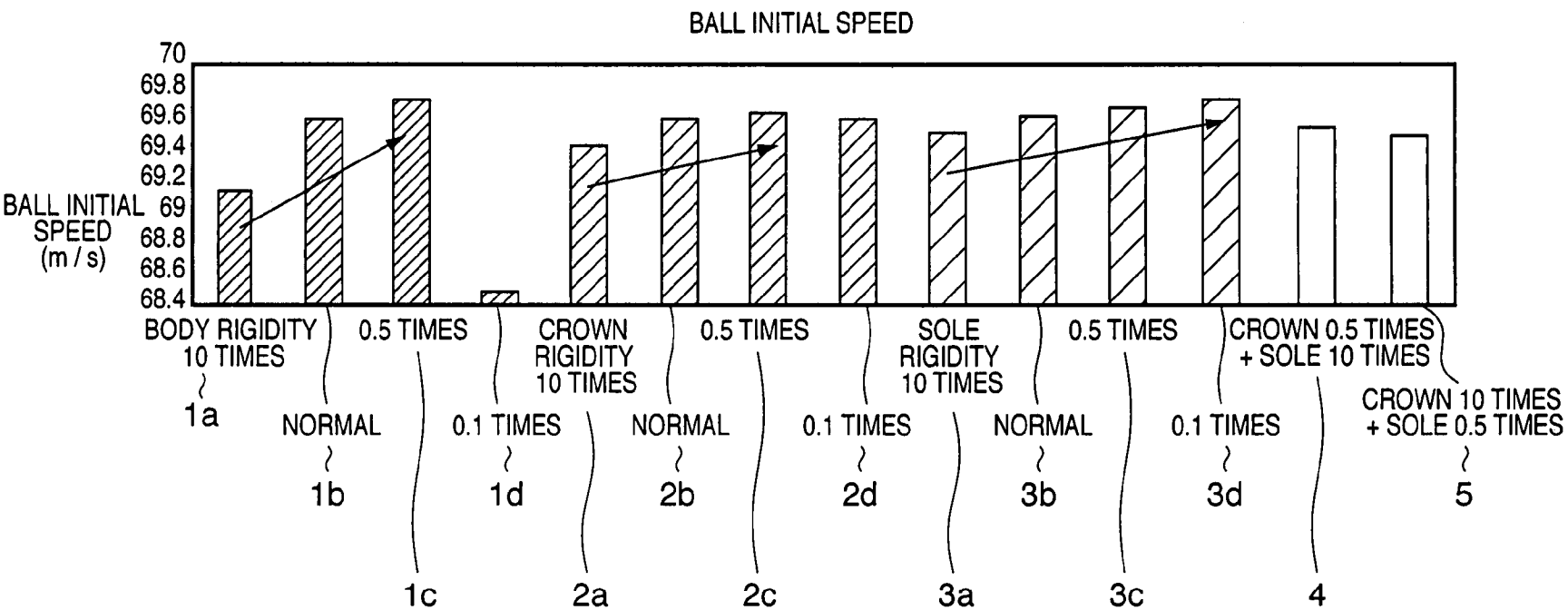
FIG. 2 is a graph showing variations of the initial speed of a ball when the body rigidity, crown rigidity, and sole rigidity of the golf club head are changed.

FIG. 2 is a graph showing variations of the initial speed of a ball when body rigidity, crown rigidity, and sole rigidity are changed. FIG. 2 is used as a comparison with the present invention in which the launch angle of a ball is increased. Referring to FIG. 2, sample numbers 1*a* to 1*d*, 2*a* to 2*d*, 3*a* to 3*d*, 4, and 5 indicate the same golf club heads as those of FIG. 1. The results of FIG. 2 show that when the rigidities of both the crown portion and sole portion are decreased, the initial speed of a ball increases.

Figure 3:
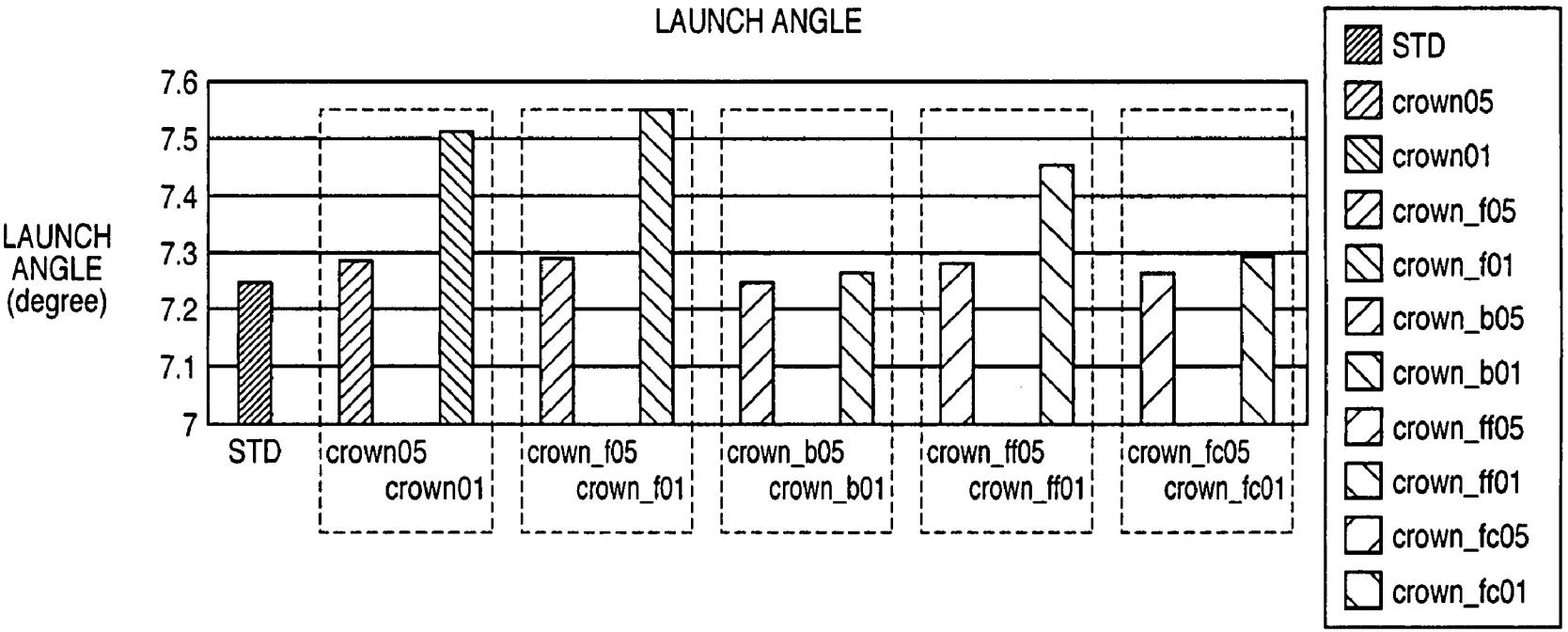
FIG. 3 is a graph showing variations of the launch angle of a ball when rigidity of a crown portion of the golf club head is changed entirely or partially.
Figure 4:
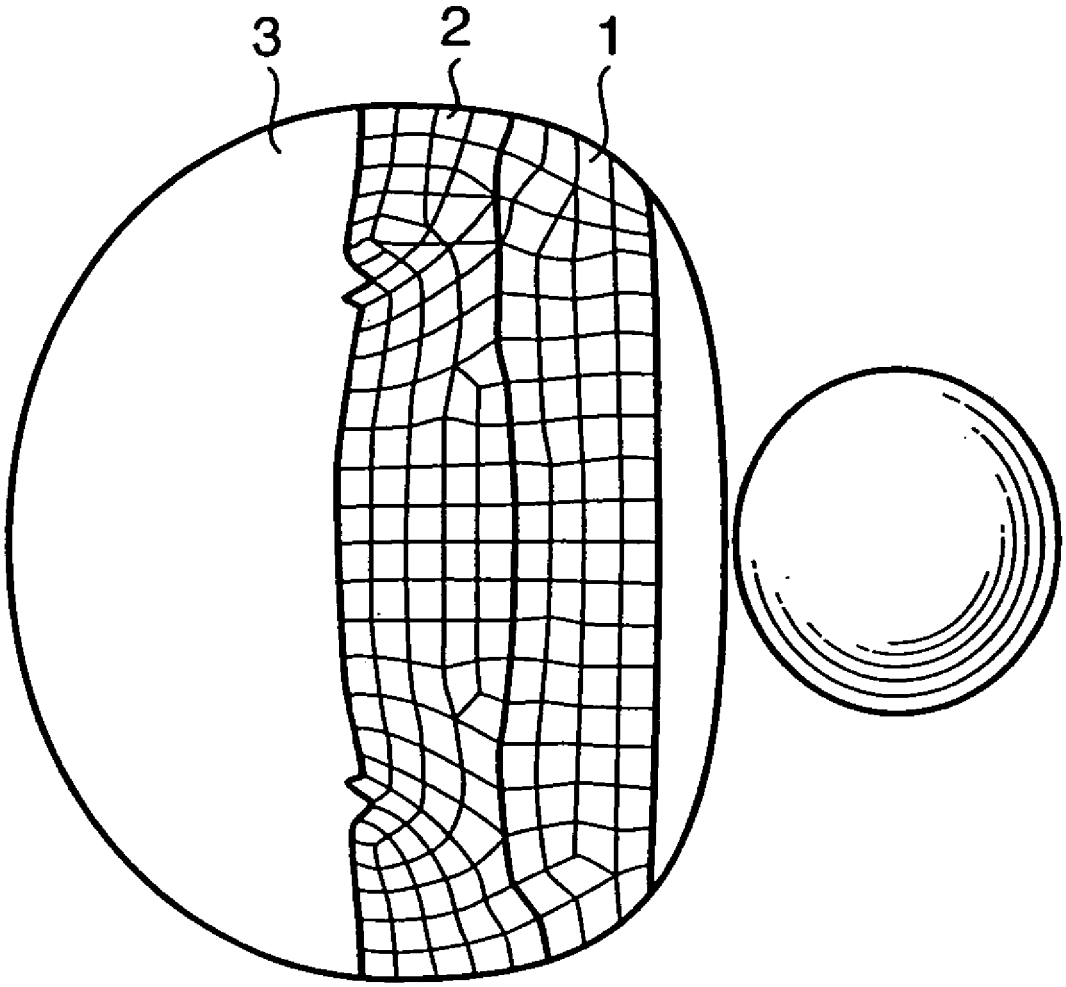
FIG. 4 is a view showing respective regions of the crown portion.

FIG. 3 is a graph showing variations of the launch angle of a ball when the rigidity of the crown portion of the golf club head is changed entirely or partially. The sample numbers in FIG. 3 indicate the samples shown in Table 1. In these samples, the rigidities of respective regions (1), (2), and (3) of the crown portion shown in FIG. 4 are set as in Table 1. The results of FIG. 3 show that when the thickness of the face-side portion of the crown portion is decreased, the effect of increasing the launch angle of a ball is large. When the thickness of only the back-side portion or central portion of the crown portion is decreased, the effect of increasing the launch angle of a ball is small.

TABLE 1

| | Rigidity Scale in Each Region (times) (ratio to titanium) | | |
|---|---|---|---|
| Sample | Region (1) | Region (2) | Region (3) |
| STD | 1 | 1 | 1 |
| crown05 | 0.5 | 0.5 | 0.5 |
| crown01 | 0.1 | 0.1 | 0.1 |
| crown_f05 | 0.5 | 0.5 | 1 |
| crown_f01 | 0.1 | 0.1 | 1 |
| crown_b05 | 1 | 1 | 0.5 |
| crown_b01 | 1 | 1 | 0.1 |
| crown_ff05 | 0.5 | 1 | 1 |
| crown_ff01 | 0.1 | 1 | 1 |
| crown_fc05 | 1 | 0.5 | 1 |
| crown_fc01 | 1 | 0.1 | 1 |

Figure 5:
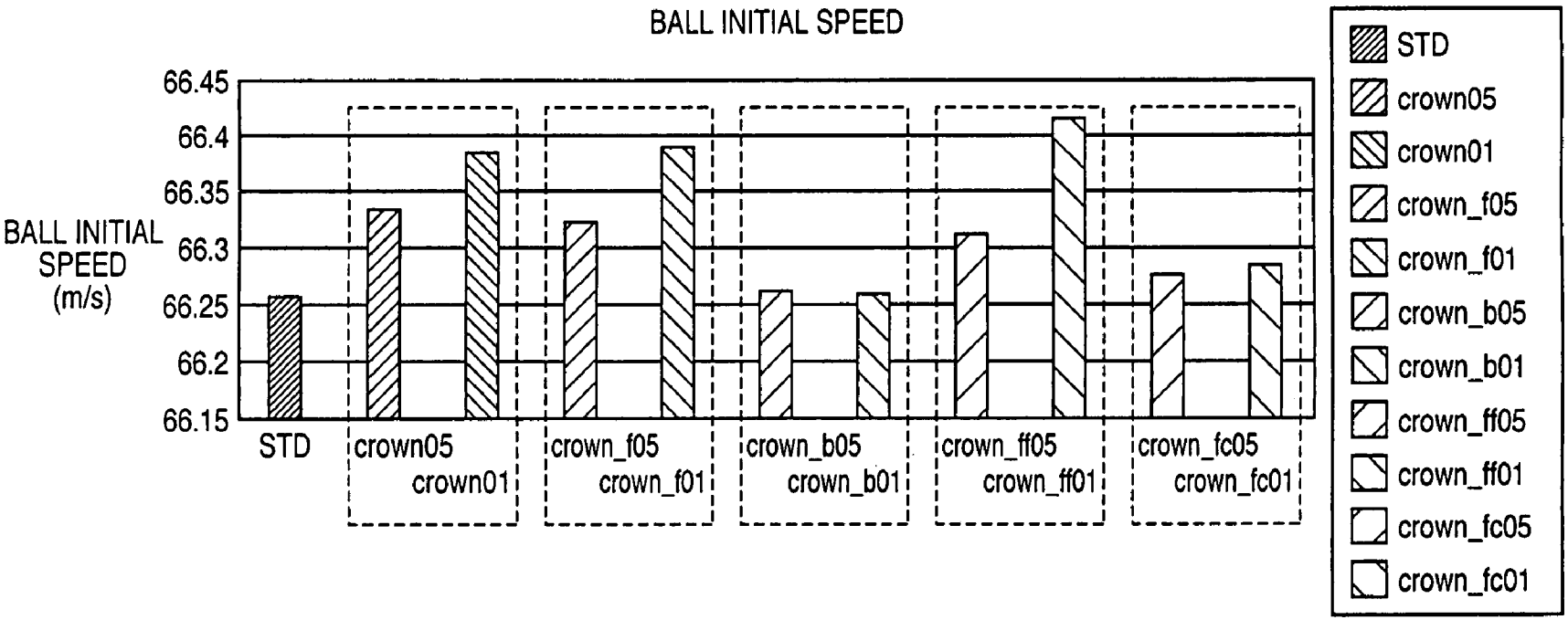
FIG. 5 is a graph showing variations of the initial speed of a ball when the rigidity of the crown portion of the golf club head is changed entirely or partially.

FIG. 5 is a graph showing variations of the initial speed of a ball when the rigidity of the crown portion of the golf club head is changed entirely or partially. The sample numbers in FIG. 5 refer to the samples shown in Table 1. The results of FIG. 5 show that when the thickness of the face-side portion of the crown portion is decreased, the effect on the increase of the initial speed of the ball is large. When the thickness of only the back-side portion or central portion of the crown portion is decreased, the effect on the increase of the initial speed of the ball is small. These results are the same as those concerning the launch angle of a ball described above.

Figure 6:
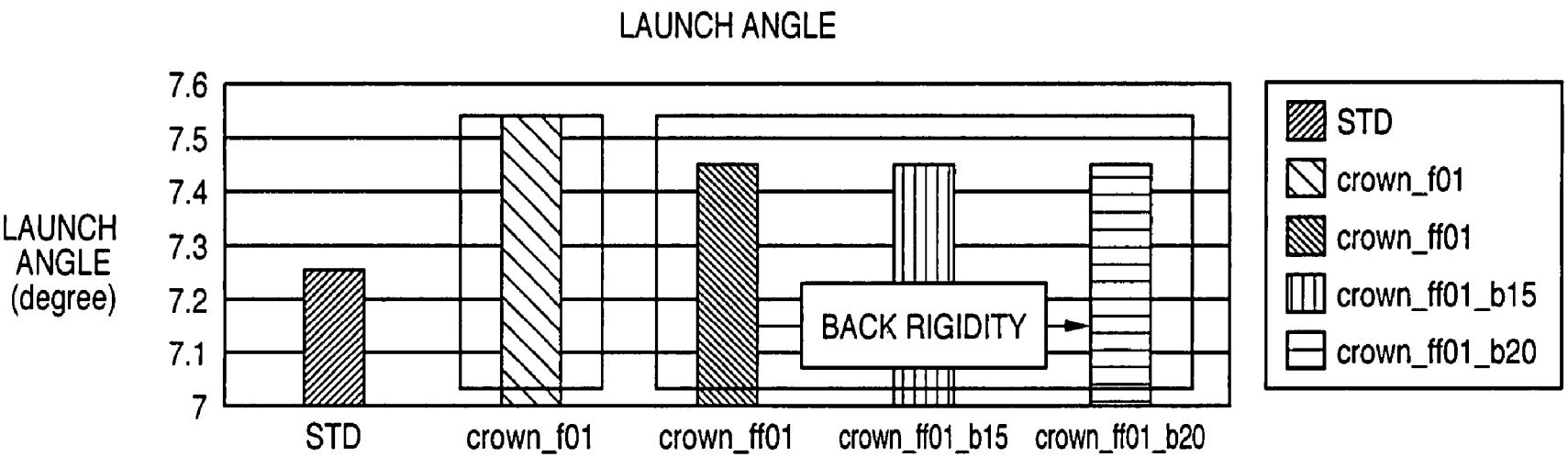
FIG. 6 is a graph showing variations of the launch angle of a ball when rigidity of a back-side region of the crown portion of the golf club head is increased.

FIG. 6 is a graph showing variations of the launch angle when the rigidity of the back-side region of the crown portion of the golf club head is increased. The sample numbers in FIG. 6 refer to the samples shown in Table 2.The results of FIG. 6 show that the rigidity of the back-side region of the crown portion hardly affects the launch angle of a ball. However, it is assumed that increasing the rigidity of the back-side portion of the crown portion favorably affects the hitting sound or hitting impression.

TABLE 2

| | Rigidity Scale in Each Region (times) (ratio to titanium) | | |
|---|---|---|---|
| Sample | Region (1) | Region (2) | Region (3) |
| STD | 1 | 1 | 1 |
| crown_f01 | 0.1 | 0.1 | 1 |
| crown_ff01 | 0.1 | 1 | 1 |
| crown_ff01_b15 | 0.1 | 1 | 15 |
| crown_ff01_b20 | 0.1 | 1 | 20 |

Figure 7:
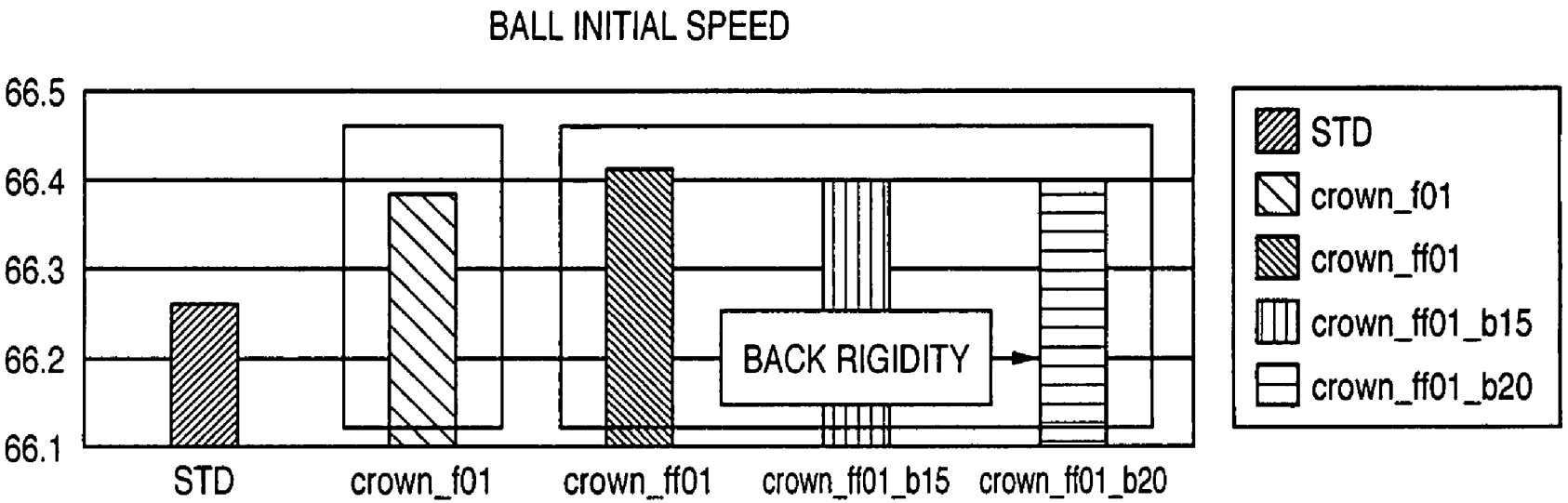
FIG. 7 is a graph showing variations of the initial speed of a ball when the rigidity of the back-side region of the crown portion of the golf club head is increased.

FIG. 7 is a graph showing variations of the initial speed of a ball when the rigidity of the back-side region of the crown portion of the golf club head is increased. The sample numbers in FIG. 7 refer to the samples shown in Table 2.The results of FIG. 7 show that the rigidity of the back-side region of the crown portion hardly affects the initial speed of a ball. These results are the same as those concerning the launch angle of a ball described above.

Figure 8:
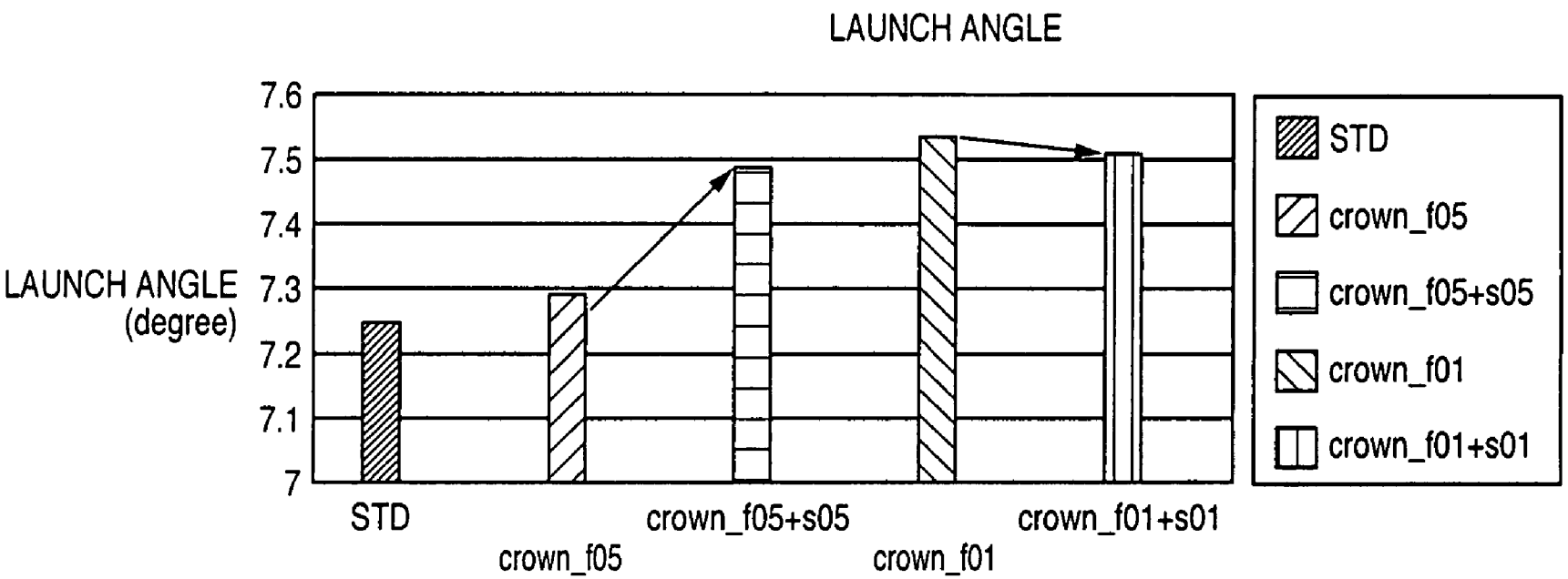
FIG. 8 is a graph showing variations of the launch angle of a ball when the rigidities of the crown portion and side portion of the golf club head are partially changed and decreased, respectively.

FIG. 8 is a graph showing variations of the launch angle when the rigidities of the crown portion and side portion of the golf club head are partially changed and decreased, respectively. The sample numbers in FIG. 8 refer to the samples shown in Table 3. The results of FIG. 8 demonstrate that when the rigidity of the side portion is decreased to a certain degree, an increase in the launch angle of a ball can be obtained. When the rigidity of the side portion is decreased excessively, the increase effect regarding the launch angle of a ball cannot be obtained.

TABLE 3

| | Rigidity Scale in Each Region (times) (ratio to titanium) | | | |
|---|---|---|---|---|
| Sample | Region (1) | Region (2) | Region (3) | Side Portion |
| STD | 1 | 1 | 1 | 1 |
| crown_f05 | 0.5 | 0.5 | 1 | 1 |
| crown_f05_s05 | 0.5 | 0.5 | 1 | 0.5 |
| crown_f01 | 0.1 | 0.1 | 1 | 1 |
| crown_f01_s01 | 0.1 | 0.1 | 1 | 0.1 |

Figure 9:
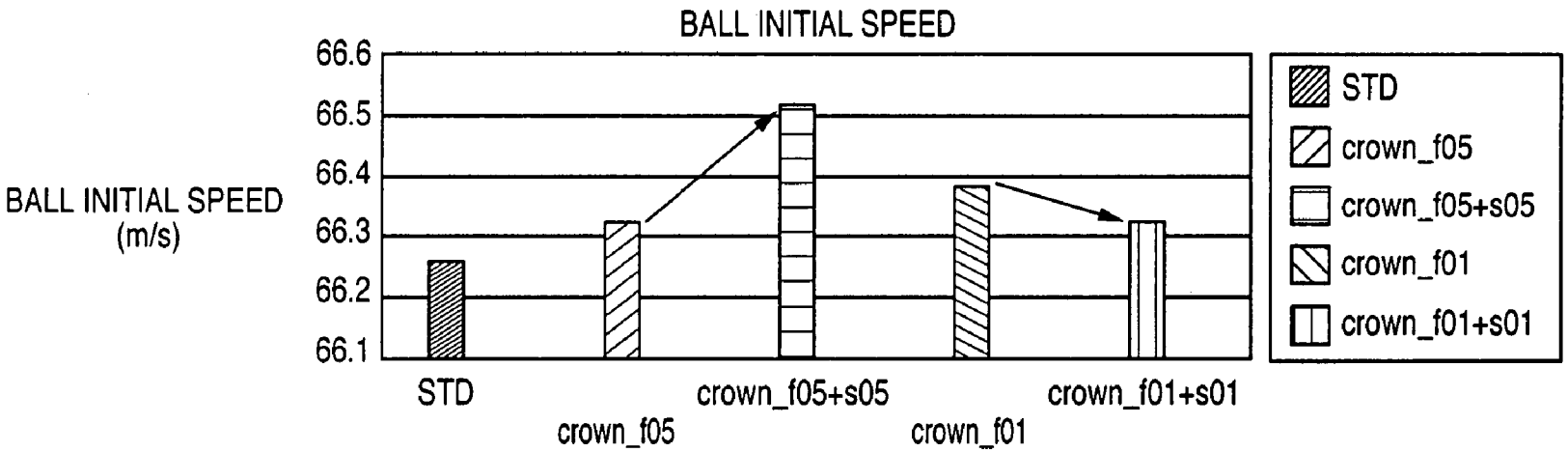
FIG. 9 is a graph showing variations of the initial speed of a ball when the rigidities of the crown portion and side portion of the golf club head are partially changed and decreased, respectively.

FIG. 9 is a graph showing variations of the initial speed of a ball when the rigidities of the crown portion and side portion of the golf club head are partially changed and decreased, respectively. The sample numbers in FIG. 9 refer to the samples shown in Table 3. The results of FIG. 9 demonstrate that when the rigidity of the side portion is decreased to a certain degree, an increase effect on the initial speed of a ball can be obtained. When the rigidity of the side portion is decreased excessively, the increase effect on the initial speed of a ball disappears. These results are the same as those concerning the launch angle of a ball described above.

Figure 10:
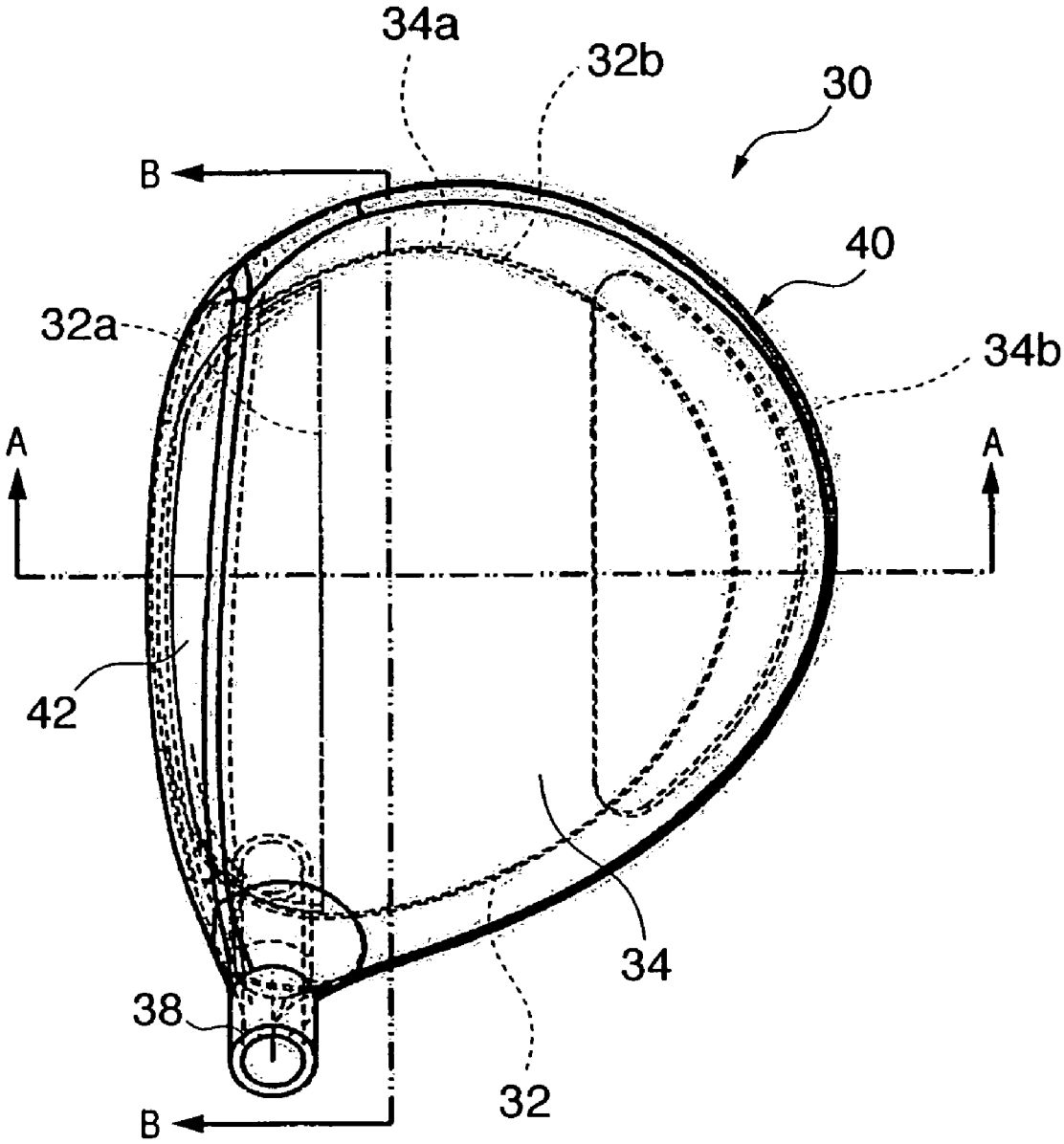
FIG. 10 is a plan view showing a golf club head according to an embodiment of the present invention.
Figure 11:
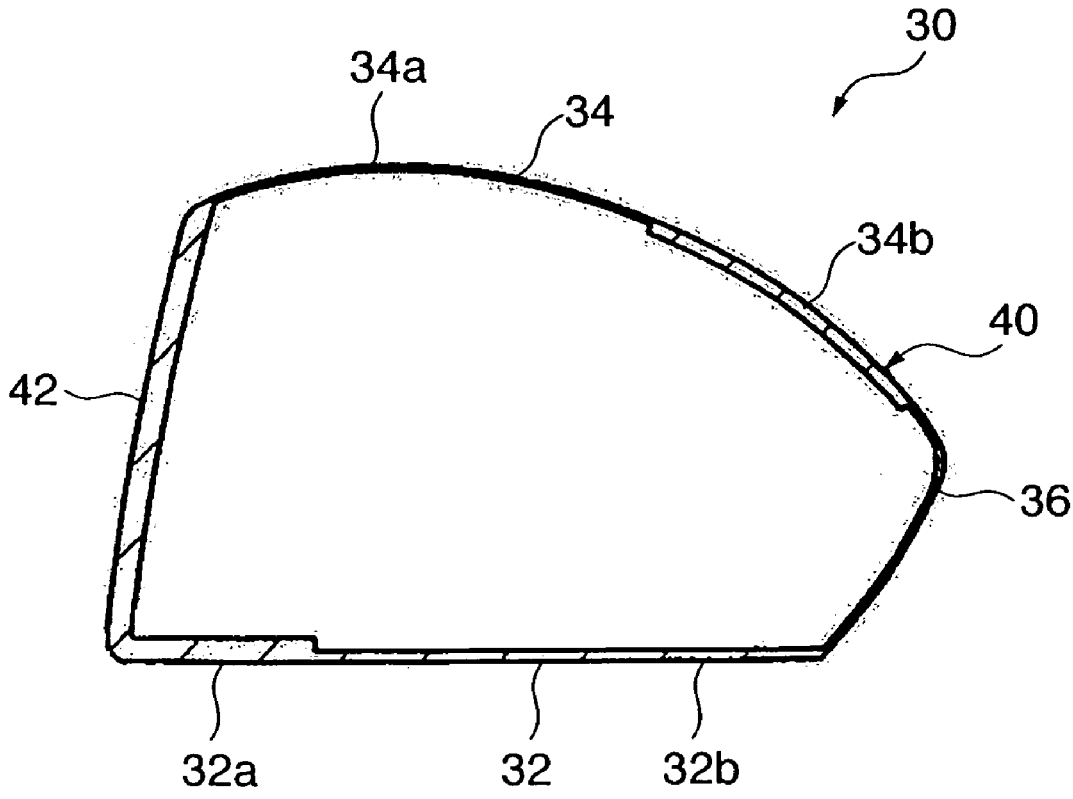
FIG. 11 is a sectional view taken along the line A-A of FIG. 10.
Figure 12:
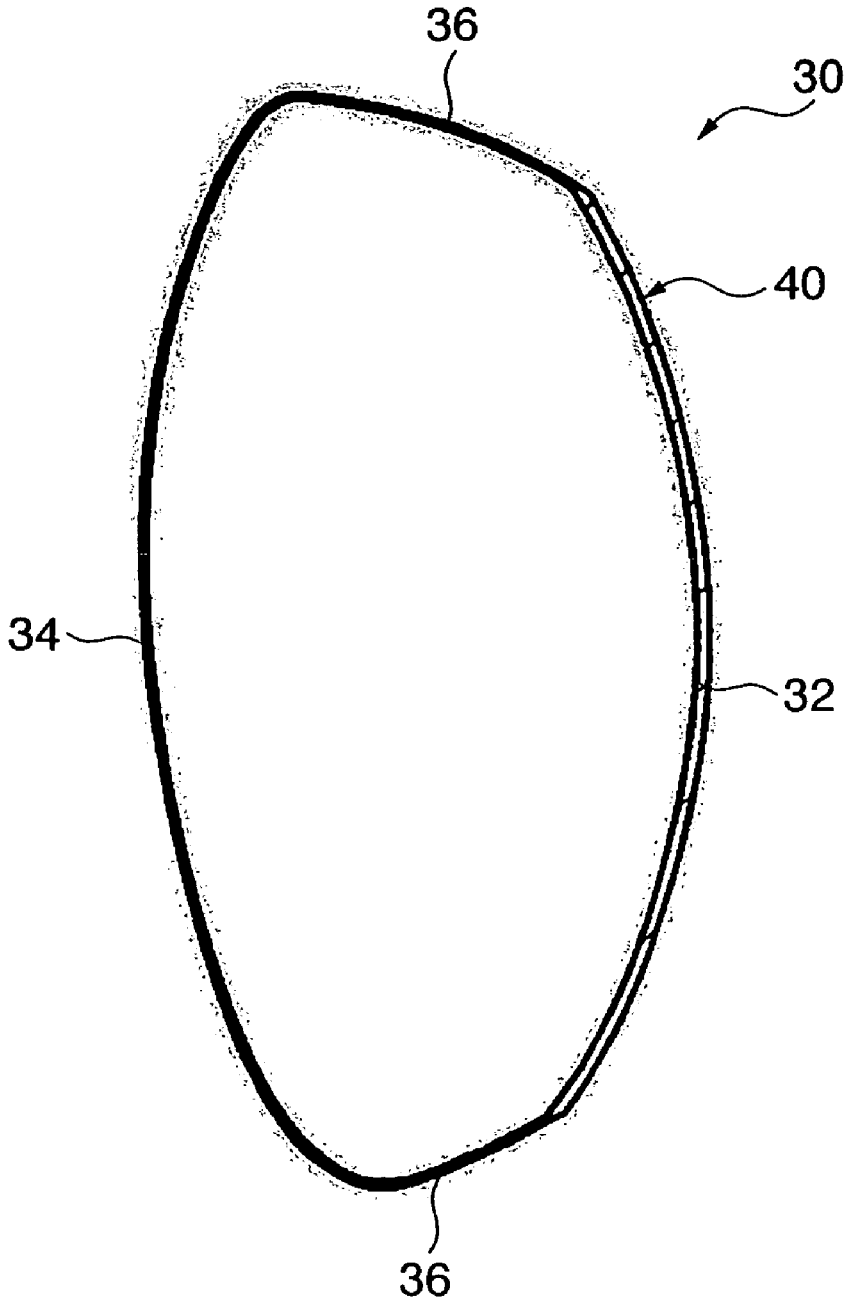
FIG. 12 is a sectional view taken along the line B-B of FIG. 10.

FIG. 10 is a plan view showing a golf club head according to an embodiment of the present invention, FIG. 11 is a sectional view taken along the line A-A of FIG. 10, and FIG. 12 is a sectional view taken along the line B-B of FIG. 10.

A golf club head 30 according to this embodiment is obtained by fixing a face member 42 to the face opening of a head main body 40 having a sole portion 32, crown portion 34, side portion 36, and hosel portion 38 by plasma welding. The material of the head main body 40 is 6-4Ti (Ti-6Al-4V) and the material of the face member 42 is SP700 (Ti-4. 5Al-3V-2Fe-2Mo). The golf club head of this embodiment is formed as a No. 1 wood golf club head having a head volume of 400 $cm^3$.

In the golf club head 30 according to this embodiment, a sole thick-walled region 32*a* having a thickness of 2.5 mm is formed as a sole high-rigidity region on the face side of the sole portion 32, and a sole thin-walled region 32*b* having a thickness of 1.2 mm is formed as a sole low-rigidity region on the back side of the sole portion 32. A crown thin-walled region 34*a* having a thickness of 0.6 mm is formed as a crown low-rigidity region on the face side of the crown portion 34, and a crown thick-walled region 34*b* having a thickness of 1.5 mm is formed as a crown high-rigidity region on the back side of the crown portion 34. The thicknesses of the sole thick-walled region 32*a*, sole thin-walled region 32*b*, crown thin-walled region 34*a*, and crown thick-walled region 34*b* are uniform.

In the golf club head 30 according to this embodiment, the ratio of the rigidity of the sole portion 32 to that of the crown portion 34 is 1:0.3, the ratio of the rigidity of the sole thick-walled region 32*a* (sole high-rigidity region) to that of the sole thin-walled region 32*b* (sole low-rigidity region) is 1:0.3, the ratio of the rigidity of the crown thick-walled region 34*b* (crown high-rigidity region) to that of the crown thin-walled region 34*a* (crown low-rigidity region) is 1:0.4, and the ratio of the rigidity of the sole portion 32 to that of the side portion 36 is 1:0.2. A value obtained such that a value of the rigidity of the sole thick-walled region 32*a* (sole high-rigidity region) is divided by a value of the rigidity of the crown thin-walled region 34*a* (crown low-rigidity region) is larger than a value obtained such that a value of the rigidity of the sole portion 32 is divided by a value of the rigidity of the crown portion 34.

In the golf club head 30 according to this embodiment, the average thickness of the sole portion 32 is 2.0 mm, and that of the crown portion 34 is 0.9 mm. Hence, in the golf club head 30 according to this embodiment, the ratio of the average thickness of the sole portion 32 to that of the crown portion 34 is 1:0.45, the ratio of the average thickness of the crown thick-walled region 34*b* to that of the crown thin-walled region 34*a* is 1:0.4, and the ratio of the average thickness of the sole thick-walled region 32*a* to that of the sole thin-walled region 32*b* is 1:0.48.

The thicknesses of the side portion 36 and face member 42 are uniform, which are 0.6 mm and 3 mm, respectively. Hence, the ratio of the average thickness of the sole portion 32 to that of the side portion 36 is 1:0.33.

The sole high-rigidity region (the thick-walled region 32*a* in the golf club head 30) can be formed from the face side end of the sole portion 32 in a range of 20 mm to 55 mm, preferably, 25 mm to 40 mm in the direction of the face side to the back side. The crown low-rigidity region (the crown thin-walled region 34*b* in the golf club head 30) can be formed from the face side end of the crown portion 34 in a range of 20 mm to 45 mm, preferably, 25 mm to 40 mm in the direction of the face side to the back side.

Figure 13:
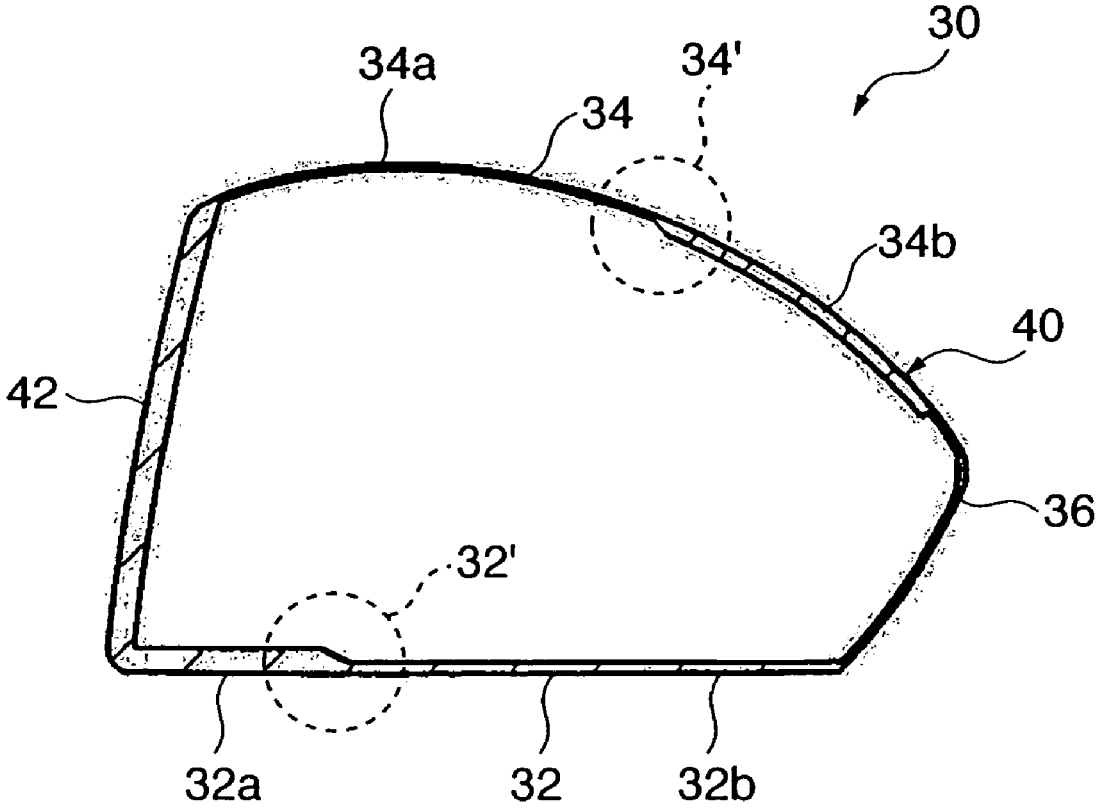
FIG. 13 is a sectional view of an alternative embodiment of the embodiment.

It is preferable that the thickness of the boundary portion between the thick-walled region 32*a* and the thin-walled region 32*b* and the thickness of the boundary portion between the thin-walled region 34*a* and the thick-walled region 34*b* can be gradually changed. FIG. 13 shows an alternative embodiment of the golf club head 30. In the alternative embodiment, the thickness of the boundary portion 32' between the thick-walled region 32*a* and the thin-walled region 32*b* and the thickness of the boundary portion 34' between the thin-walled region 34*a* and the thick-walled region 34*b* are gradually changed. This construction reduces the stress concentration at the boundary potions 32' and 34'.

The high-rigidity region and the low-rigidity region can be formed by not only the change of the thickness but also various manners. For example, the high-rigidity region is formed by a material of high young's modulus and the low-rigidity region is formed by a material of low young's modulus. Copper alloy, stainless alloy, molded titanium alloy (Ti-6Al-4V, etc) and B-type titanium alloy (the B phase is deposited) are available as the material of the high-rigidity region, and aluminum alloy and B-type titanium alloy (the B phase is not deposited) are available as the material of the low-rigidity region.

Figure 14:
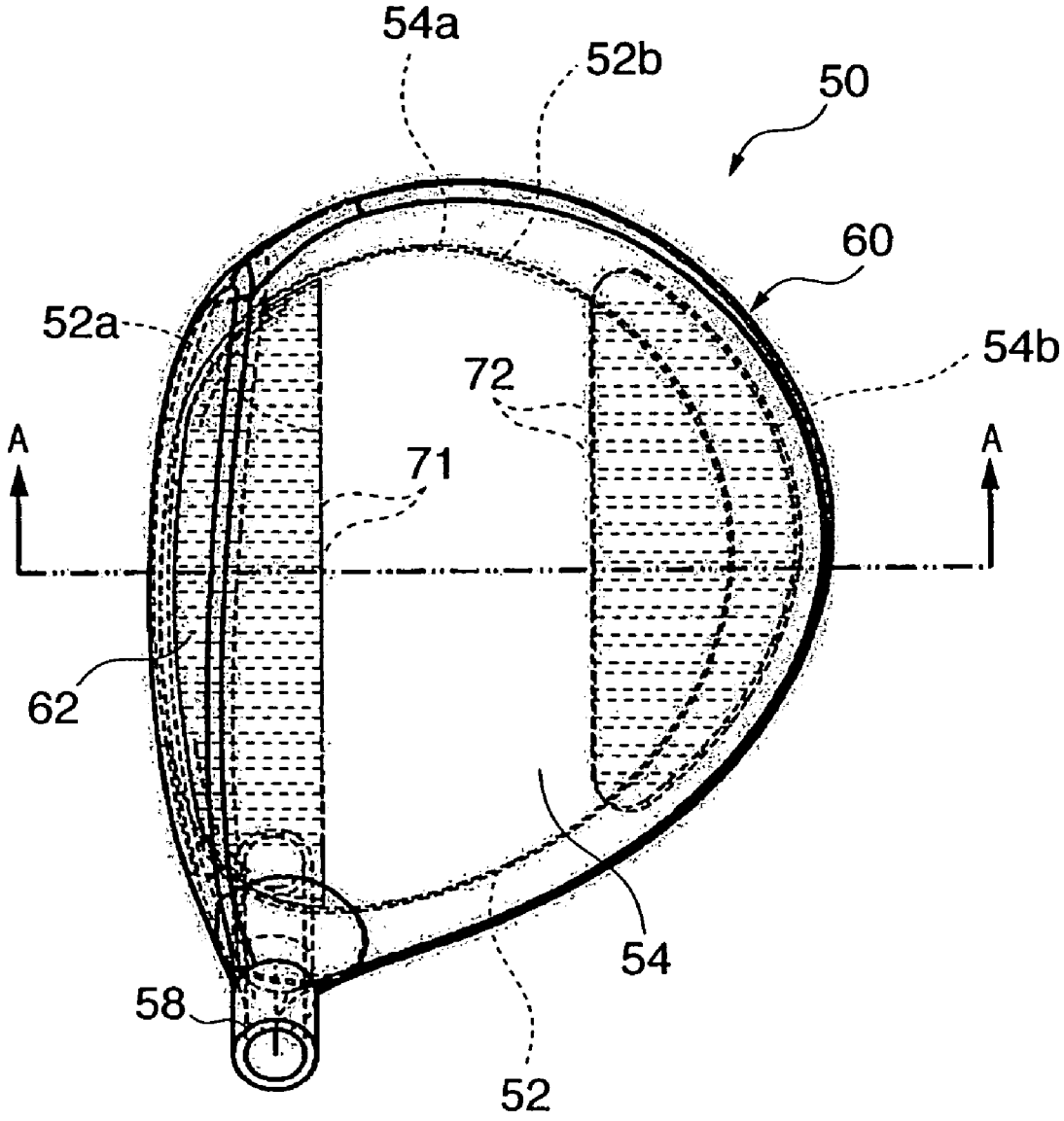
FIG. 14 is a plan view showing a golf club head according another embodiment of the present invention.
Figure 15:
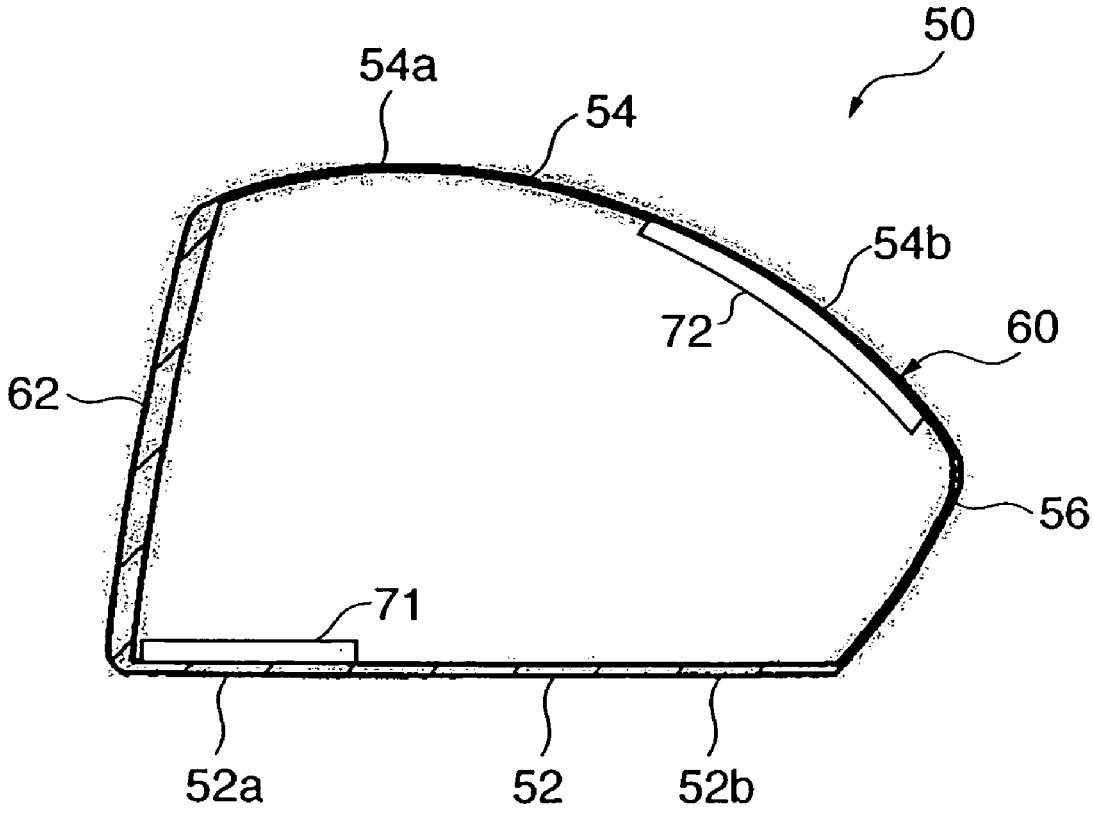
FIG. 15 is a sectional view taken along the line A-A of FIG. 14.

The high-rigidity region and the low-rigidity region can be formed by providing ribs in the high-rigidity region. FIG. 14 is a plan view showing a golf club head according to another embodiment of the present invention, FIG. 15 is a sectional view taken along the line A-A of FIG. 14.

A golf club head 50 according to this embodiment is obtained by fixing a face member 62 to the face opening of a head main body 60 having a sole portion 52, crown portion 54, side portion 56, and hosel portion 58 by plasma welding. The golf club head of this embodiment is formed as a No. 1 wood golf club head.

In the golf club head 50 according to this embodiment, the sole portion 52 has a sole high-rigidity region 52*a* on the face side of the sole portion 52 and a sole low-rigidity region 52*b* on the back side of the sole portion 52. The crown portion 54 has a crown low-rigidity region 54*a* on the face side of the crown portion 54 and a crown high-rigidity region 54*b* on the back side of the crown portion 54.

Figure 16:
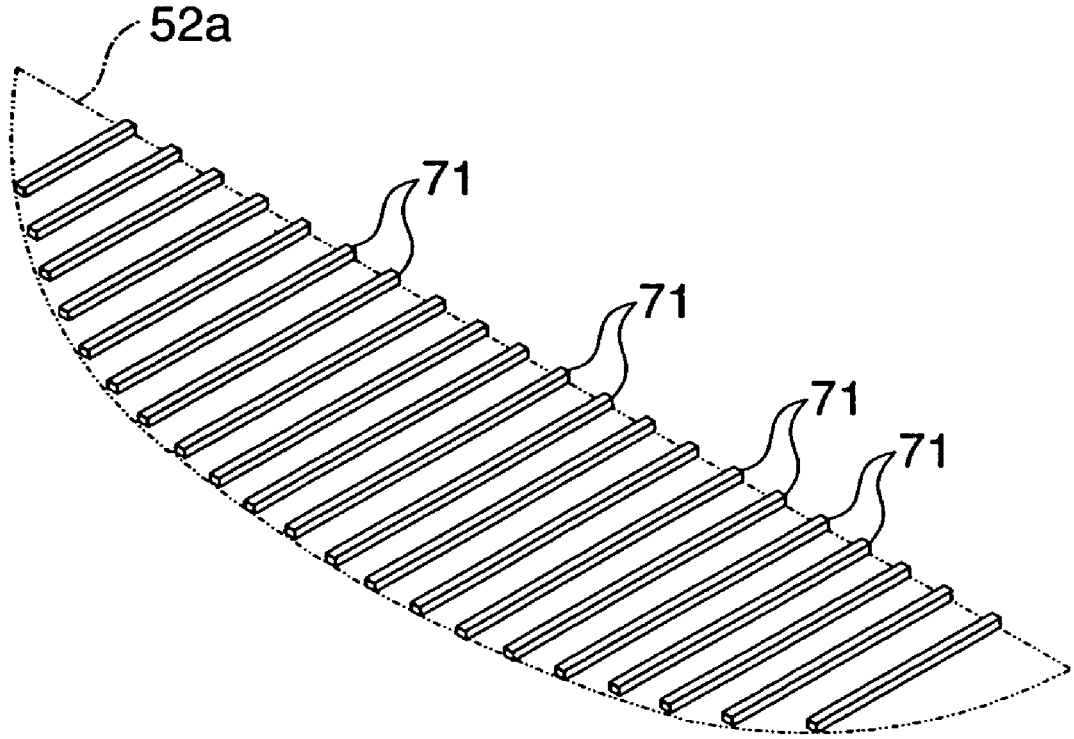
FIG. 16 is a view for explaining ribs of the another embodiment.

Ribs 71 are provided in the sole high-rigidity region 52*a* and ribs 72 are provided in the crown high-rigidity region 54*b*. FIG. 16 is a perspective illustration of the ribs 71. The ribs 71 and 72 extend in the direction of the face side to the back side. The ribs 71 and 72 can be integrally formed with the head main body 60. The ribs 71 and 72 can be also formed by fixing members of the ribs 71 to the sole portion 52 and by fixing members of the ribs 72 to the crown portion 54.

Figure 17:
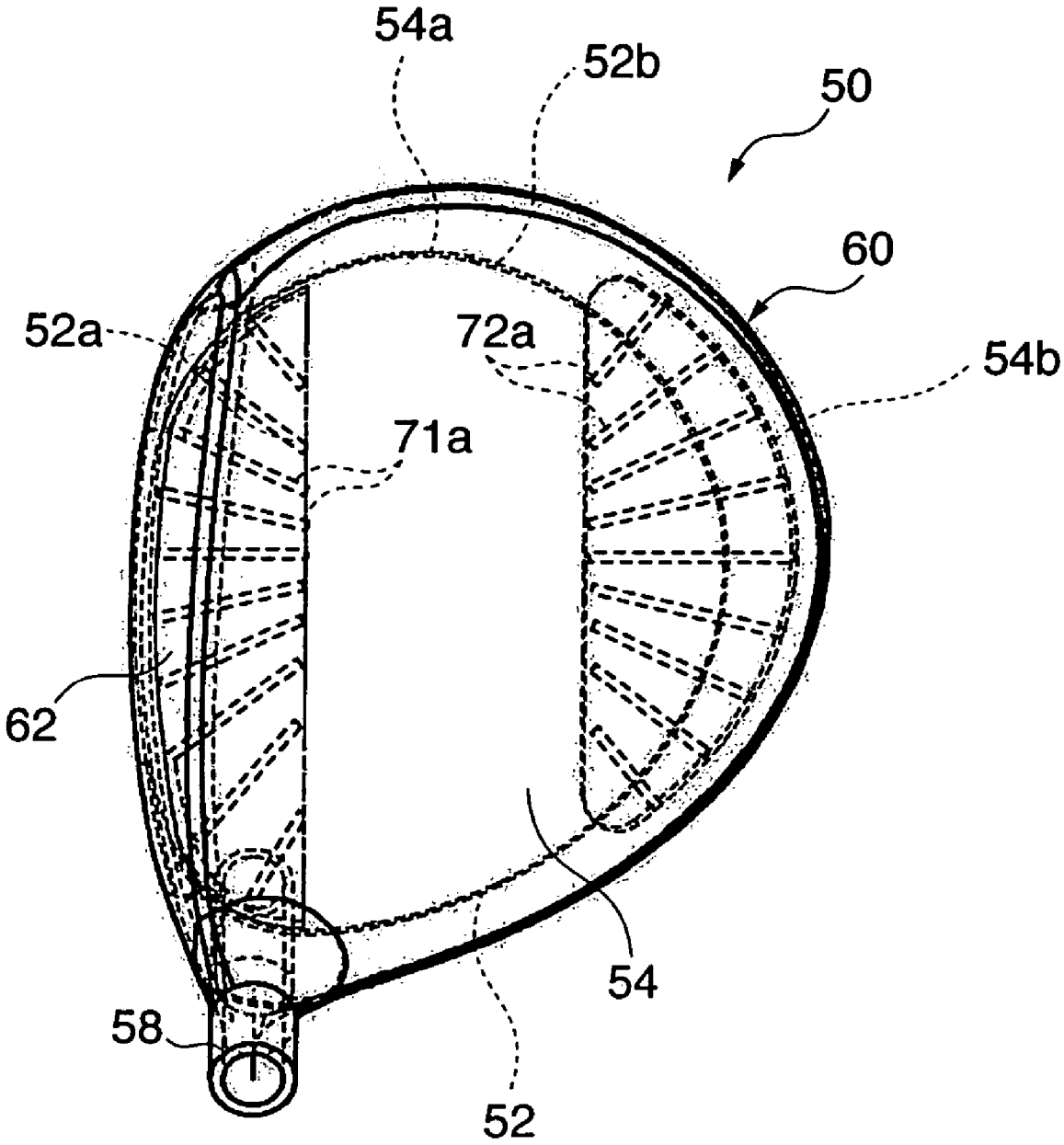
FIG. 17 is a plan view showing a golf club head according an alternative embodiment of the another embodiment.
Figure 18:
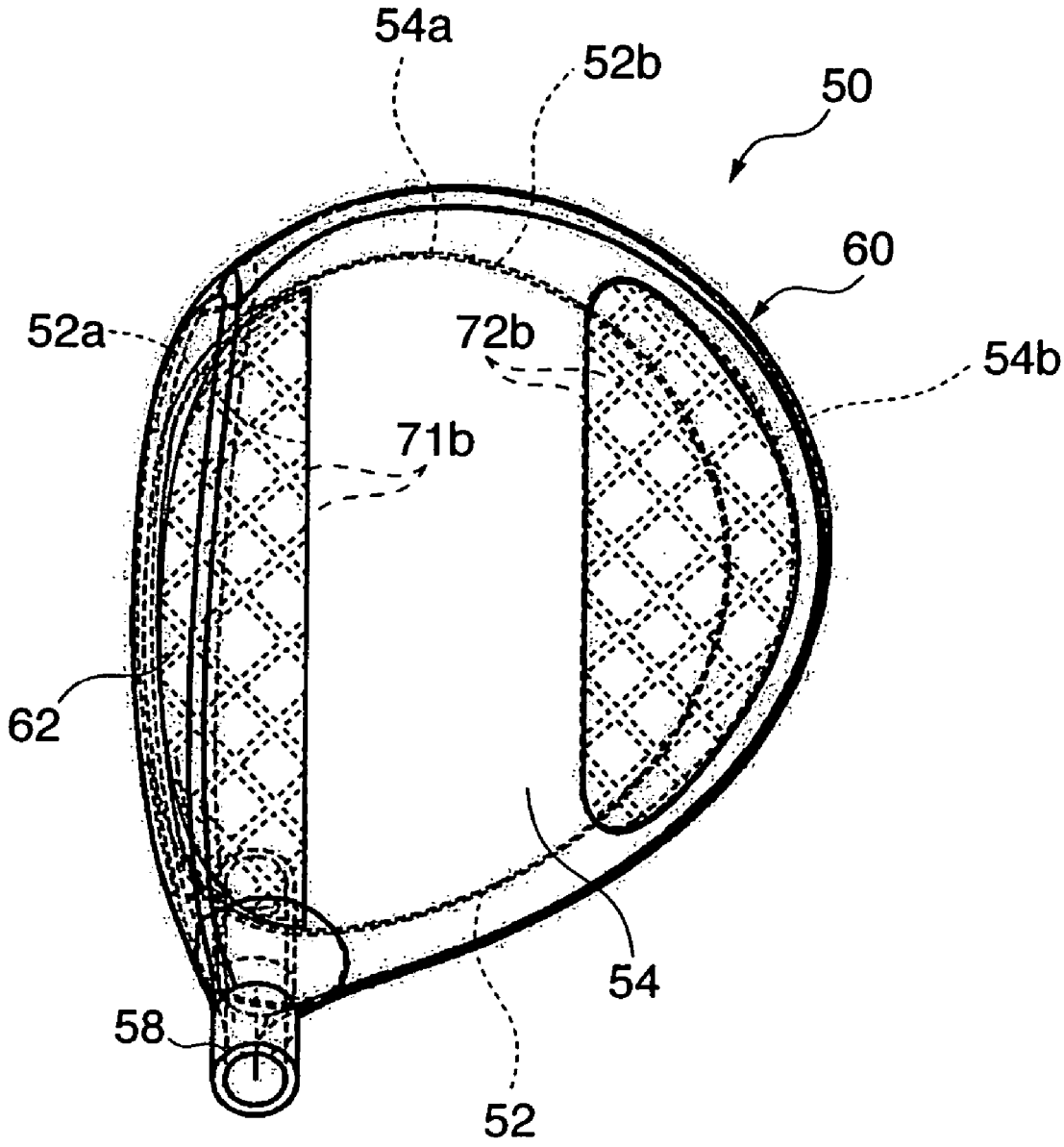
FIG. 18 is a plan view showing a golf club head according another alternative embodiment of the another embodiment.

Various arrangements of the ribs are selectable. FIG. 17 shows an alternative embodiment of the golf club head 50. In the embodiment shown in FIG. 17, ribs 71*a* in the sole high-rigidity region 52*a* and ribs 72*a* in the crown high-rigidity region 54*b* are radially arranged. FIG. 18 shows another alternative embodiment of the golf club head 50. In the embodiment shown in FIG. 18, ribs 71*b* in the sole high-rigidity region 52*a* and ribs 72*b* in the crown high-rigidity region 54*b* form grid pattern.

As described above, the high-rigidity region and the low-rigidity region can be formed by various manners. The various manners can be combined each other.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2005-241748 filed on Aug. 23, 2005, the entire contents of which are hereby incorporated by reference herein.

What is claimed is:

1. A hollow golf club head having a sole portion, a crown portion and a side portion, wherein a ratio of a rigidity of said sole portion to that of said crown portion is 1:0.1 to 0.8, a crown low-rigidity region is formed on a face side of said crown portion, a crown high-rigidity region is formed on a back side of said crown portion, and a ratio of a rigidity of said crown high-rigidity region to that of said crown low-rigidity region is 1:0.2 to 0.6, and wherein the crown low rigidity region extends from the face side end of the crown portion at a substantially constant rigidity at least 20 mm toward the back side of said crown portion, and wherein said sole portion includes a sole high-rigidity region formed on a face side and a sole low-rigidity region formed on a back side, and wherein a thickness of said side portion is the same as a thickness of said crown low-rigidity region.

2. The golf club head according to claim 1, wherein a ratio of the rigidity of said sole portion to that of said side portion is 1:0.1 to 0.8.

3. The golf club head according to claim 1, wherein a head volume is 250 $cm^3$ to 470 $cm^3$ and a loft angle is 7° to 15°.

4. The golfclub head according to claim 1, wherein a head volume is 150 $cm^3$ to 250 $cm^3$ and a loft angle is in a range from 12 to 28 degrees.

5. The golf club head according to claim 1, wherein a head volume is 70 $cm^3$ to 150 $cm^3$ and a loft angle is in a range from 15 to 32 degrees.

6. The golf club head according to claim 1, wherein the crown low-rigidity region extends from the face side end of the crown portion at a substantially constant rigidity in a range of 20 mm to 45 mm toward the back side of the said crown portion.

7. The golf club head according to claim 1, wherein the crown low-rigidity region extends from the face side end of the crown portion at a substantially constant rigidity in a range of 25 mm to 40 mm toward the back side of the said crown portion.

8. The golf club head according to claim 1, wherein the ratio of the rigidity of said sole portion to that of said crown portion is 1:0.3.

9. The golf club head according to claim 1, wherein the ratio of the rigidity of said crown high-rigidity region to that of said crown low-rigidity region is 1:0.4.

10. A hollow golf club head having a sole portion, a crown portion and a side portion, wherein a ratio of a rigidity of said sole portion to that of said crown portion is 1:0.1 to 0.8, a sole high-rigidity region is formed on a face side of said sole portion, a sole low-rigidity region is formed on a back side of said sole portion, and a ratio of a rigidity of said sole high-rigidity region to that of said sole low-rigidity region is 1:0.2 to 0.5, and wherein the sole high rigidity region extends from the face side end of the sole portion at a substantially constant rigidity less then 40 mm toward the back hide of said sole portion, and wherein said crown portion includes a crown low-rigidity region formed on a face side and a crown high-rigidity region formed on a back side, and wherein a thickness of said side portion is the same as a thickness of said crown low-rigidity region.

11. The golf club head according to claim 10, wherein a ratio of the rigidity of said sole portion to that of said side portion is 1:01 to 0.8.

12. The golf club head according to claim 10, wherein a head volume is 250 $cm^3$ to 470 $cm^3$ and a loft angle is 7° to 15°.

13. The golf club head according to claim 10, wherein a head volume is 150 $cm^3$ to 250 $cm^3$ and a loft angle is in a range from 12 to 28 degrees.

14. The golf club head according to claim 10, wherein a head volume is 70 $cm^3$ to 150 $cm^3$ and a loft angle is in a range from 15 to 32 degrees.

15. The golf club head according to claim 10, wherein the sole high-rigidity region extends from the face side end of the sole portion at a substantially constant rigidity in a range of 25 mm to 40 mm toward the back side of said sole portion.

16. The golf club head according to claim 10, wherein the ratio of the rigidity of said sole portion to that of said crown portion is 1:0.3.

17. The golf club head according to claim 10, wherein the ratio of the rigidity of said sole high-rigidity region to that of said sole low-rigidity region is 1:0.3.

18. A hollow golf club head having a sole portion, a crown portion and a side portion, wherein a ratio of a rigidity of said sole portion to that of said crown portion is 1:0.1 to 0.8, a crown low-rigidity region is formed on a face side of said crown portion, a crown high-rigidity region is formed on a back side of said crown portion, a ratio of a rigidity of said crown high-rigidity region to that of said crown low-rigidity region is 1:0.2 to 0.6, a sole high-rigidity region is formed on a face side of said sole portion, a sole low-rigidity region is formed on a back side of said sole portion, and a ratio of a rigidity of said sole high-rigidity region to that of said sole low-rigidity region is 1:0.2 to 0.5, and wherein the crown low rigidity region wherein the crown low rigidity region extends from the face side end of the crown portion at a substantially constant rigidity at least 20 mm toward the back side of said crown portion, and wherein the sole high rigidity region extends from the face side end of the sole portion at a substantially constant rigidity less then 40 mm toward the back side of said sole portion, and wherein a thickness of said side portion is the same as a thickness of said crown low-rigidity region.

19. The golf club head according to claim 18, wherein a value obtained such that a value of the rigidity of said sole high-rigidity region is divided by a value of the rigidity of said crown low-rigidity region is larger than a value obtained such that a value of the rigidity of said sole portion is divided by a value of the rigidity of said crown portion.

20. The golf club head according to claim 18, wherein a ratio of the rigidity of said sole portion to that of said side portion is 1:0.1 to 0.8.

21. The golf club head according to claim 18, wherein a head volume is 250 $cm^3$ to 470 $cm^3$ and a loft angle is 7° to 15°.

22. The golf club head according to claim 18, wherein a head volume is 150 $cm^3$ to 250 $cm^3$ and a loft angle is in a range from 12 to 28 degrees.

23. The golf club head according to claim 8, wherein a head volume is 70 $cm^3$ to 150$cm^3$ and a loft angle is in a range from 15 to 32 degrees.

* * * * *